US006568605B1

(12) United States Patent
Chen

(10) Patent No.: US 6,568,605 B1
(45) Date of Patent: May 27, 2003

(54) MANUAL CONTROL STRUCTURES OF A PISTOL-TYPE SPRAY NOZZLE

(75) Inventor: Chin-Yuan Chen, Chang-Hua Hsien (TW)

(73) Assignee: Shin Tai Spurt Water of the Garden Tools Co., Ltd., Chang-Hua Hsien (TW)

( * ) Notice: Subject to any disclaimer, the term of this patent is extended or adjusted under 35 U.S.C. 154(b) by 0 days.

(21) Appl. No.: 10/326,313

(22) Filed: Dec. 23, 2002

(51) Int. Cl.[7] ..... B05B 7/02; B05B 15/06; B05B 1/30; B05B 15/08

(52) U.S. Cl. ..... 239/525; 239/532; 239/574; 239/587.1

(58) Field of Search ..... 239/525, 532, 239/574, 587.1, 526, 569, 581.1, 587.4, 587.5, 587.6, 588, 600

(56) References Cited

U.S. PATENT DOCUMENTS 6,216,965 B1 * 4/2001 Chao ..... 239/587.4
6,220,527 B1 * 4/2001 Chen et al. ..... 239/532

* cited by examiner

*Primary Examiner*—Michael Mar
*Assistant Examiner*—Darren Gorman
(74) *Attorney, Agent, or Firm*—Harrison & Egbert

(57) ABSTRACT

A pistol-type spray nozzle includes a handle, a water guiding inner tube, a first water control valve, a second water control valve, a link rod, a control lever, and a thumbknob. The second water control valve is rotatably disposed in the top segment of the water guiding inner tube. The thumbknob is fastened to the second water control valve such that the thumbknob partially juts out of the handle. The thumbknob is used to actuate the second water control valve so as to turn on or off the water flow of the spray nozzle.

2 Claims, 9 Drawing Sheets

MANUAL CONTROL STRUCTURES OF A PISTOL-TYPE SPRAY NOZZLE

FIELD OF THE INVENTION

The present invention relates generally to a pistol-type spray nozzle, and more particularly to manual control structures for turning on or off the water flow and for adjusting the spray direction of the nozzle head of the pistol-type nozzle.

BACKGROUND OF THE INVENTION

The conventional pistol-type spray nozzle is generally provided with a control lever and an auxiliary control switch similar in function to the control lever. The control lever and the auxiliary control switch cannot be manually maneuvered with one hand. It is conceivably inconvenient to a user of the conventional pistol-type spray nozzle that both hands of the user are needed to control the operations of the control lever and the auxiliary control switch.

BRIEF SUMMARY OF THE INVENTION

The primary objective of the present invention is to provide a pistol-type spray nozzle with a control structure comprising a control lever and a thumbknob, which can be operated simultaneously with one hand.

It is another objective of the present invention to provide a pistol-type spray nozzle with a control structure enabling the nozzle head to be adjusted in spray direction in a step-by-step manner by turning the handle of the pistol-type spray nozzle.

The features, functions, and advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
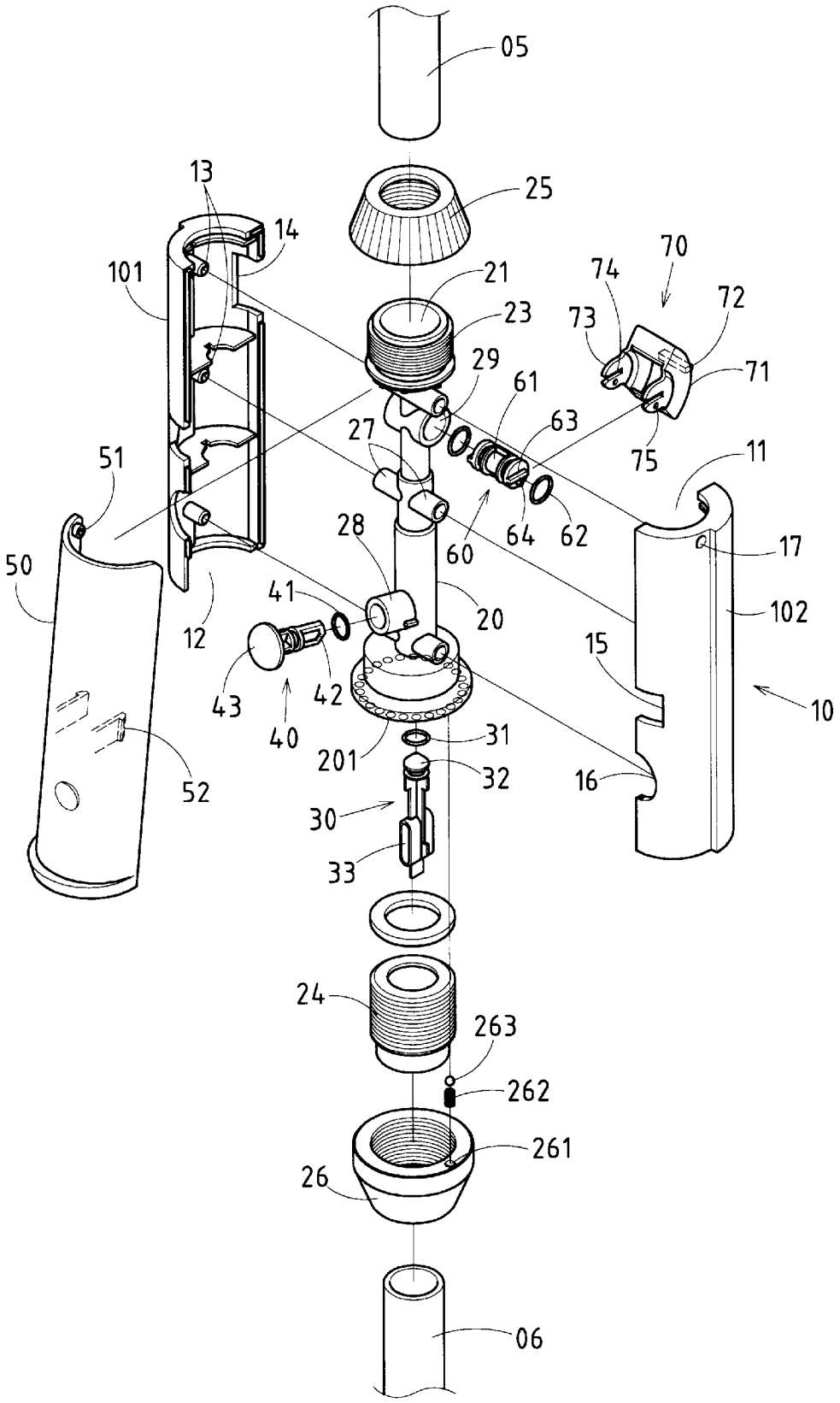
FIG. 1 shows an exploded perspective view of the preferred embodiment of the present invention.
Figure 2:
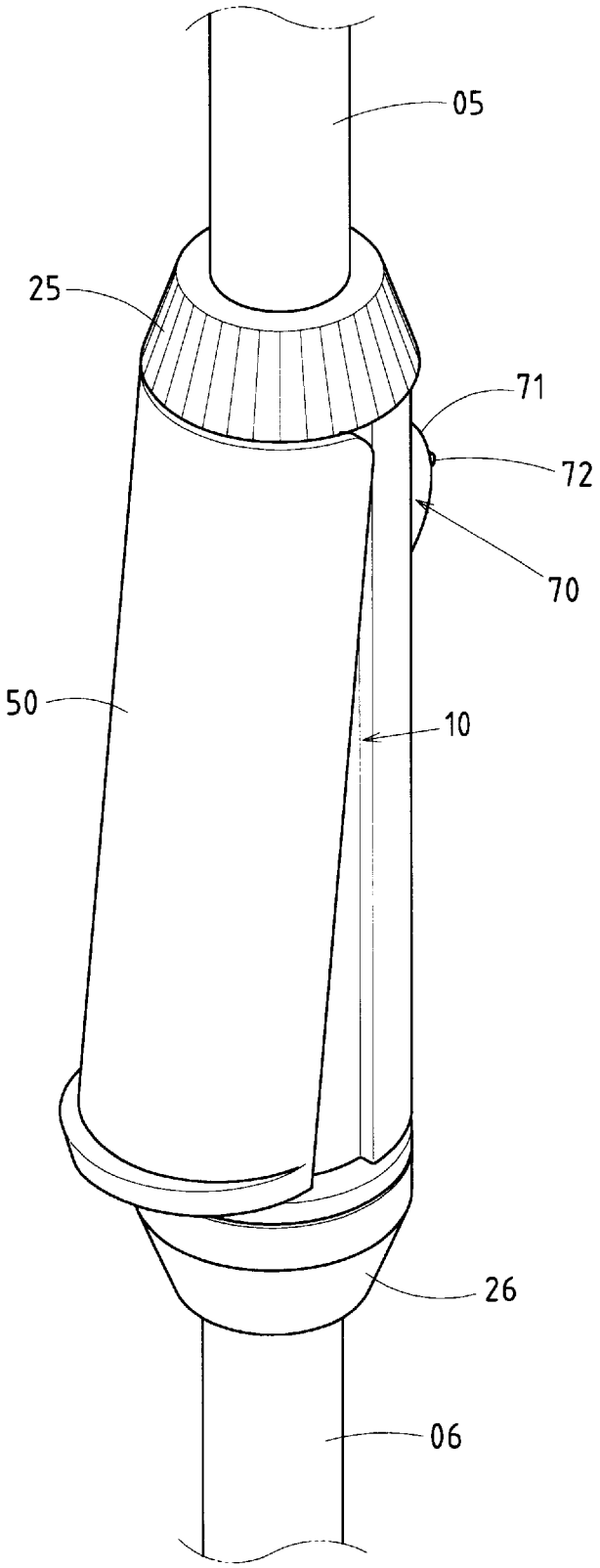
FIG. 2 shows a perspective view of the preferred embodiment of the present invention.
Figure 3:
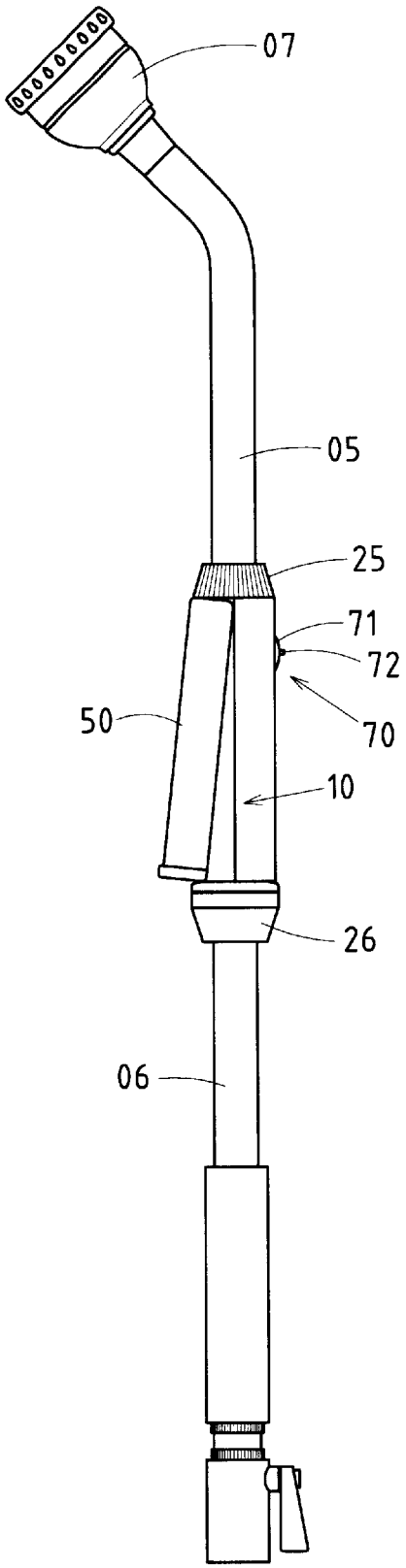
FIG. 3 shows a side schematic view of the preferred embodiment of the present invention.

As shown in FIGS. 1–7, a pistol-type spray nozzle embodied in the present invention comprises the component parts which are described hereinafter.

A handle 10 is formed of a first housing 101 and a second housing 102, which are opposite to each other. The handle 10 is provided with a top hole 11 and a bottom hole 12. The handle 10 is provided in the inner wall with a plurality of fastening pillars 13, in the top segment of the rear side with a receiving slot 14, in the midsegment of the front side with a retaining slot 15, in the bottom segment of the front side with a through slot 16, and in the top segments of two sides with a pivoting hole 17.

Figure 4:
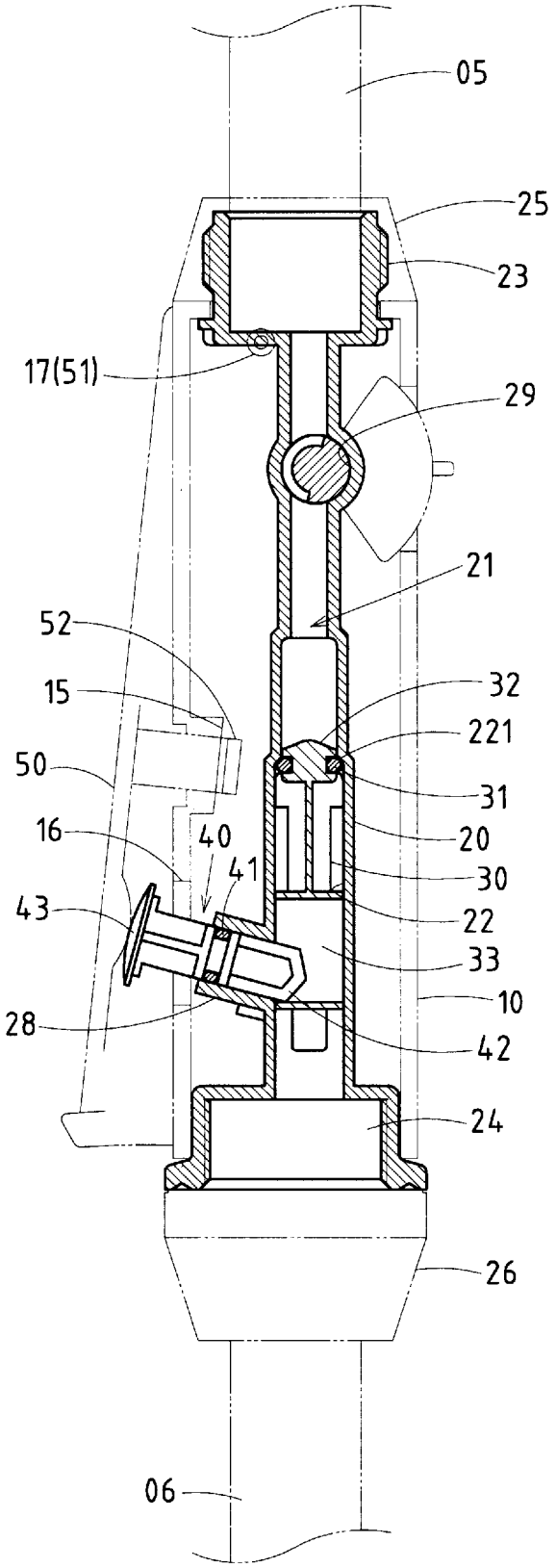
FIG. 4 shows a longitudinal sectional view of the preferred embodiment of the present invention with the control lever thereof being not at work.

A water guiding inner tube 20 is disposed in the center of the handle 10 and is provided with a longitudinal water duct 21 which is provided at the bottom segment with a valve slot 22 having an enlarged inner diameter, as shown in FIG. 4. The water guiding inner tube 20 is provided at the top end and the bottom end with an upper threaded tube 23, a lower threaded tube 24, which are respectively extended out of the top hole 11 and the bottom hole 12 to engage an upper fastening ring 25 and a lower fastening ring 26 for fastening the handle 10 with a top rod 05 and a bottom rod 06 of the pistol-type spray nozzle. The water guiding inner tube 20 is provided with a plurality of fastening tubes 27 which are arranged at intervals to join with the fastening pillars 13 of the handle 10. The water guiding inner tube 20 is provided in the bottom segment with an inclined projected tube 28, and in the top segment with a horizontal through slot 29.

A first water control valve 30 is disposed in the valve slot 22 and is provided at the top end with a tapered head 32 which is in turn provided with a washer 31 and is capable of joining with a narrow edge 221 of the valve slot 22. The first water control valve 30 is provided at the bottom end with a horizontal through slot 33 facing the inclined projected tube 28.

A link rod 40 is inserted into the inclined projected tube 28 and is provided with a washer 41 fitted thereover. The link rod 40 has a triangular inner end 42, which is disposed in the through slot 33 of the first water control valve 20. The link rod 40 further has a semispherical outer end 43, which is jutted out of the inclined projected tube 28 and the through slot 16 of the handle 10.

Figure 6:
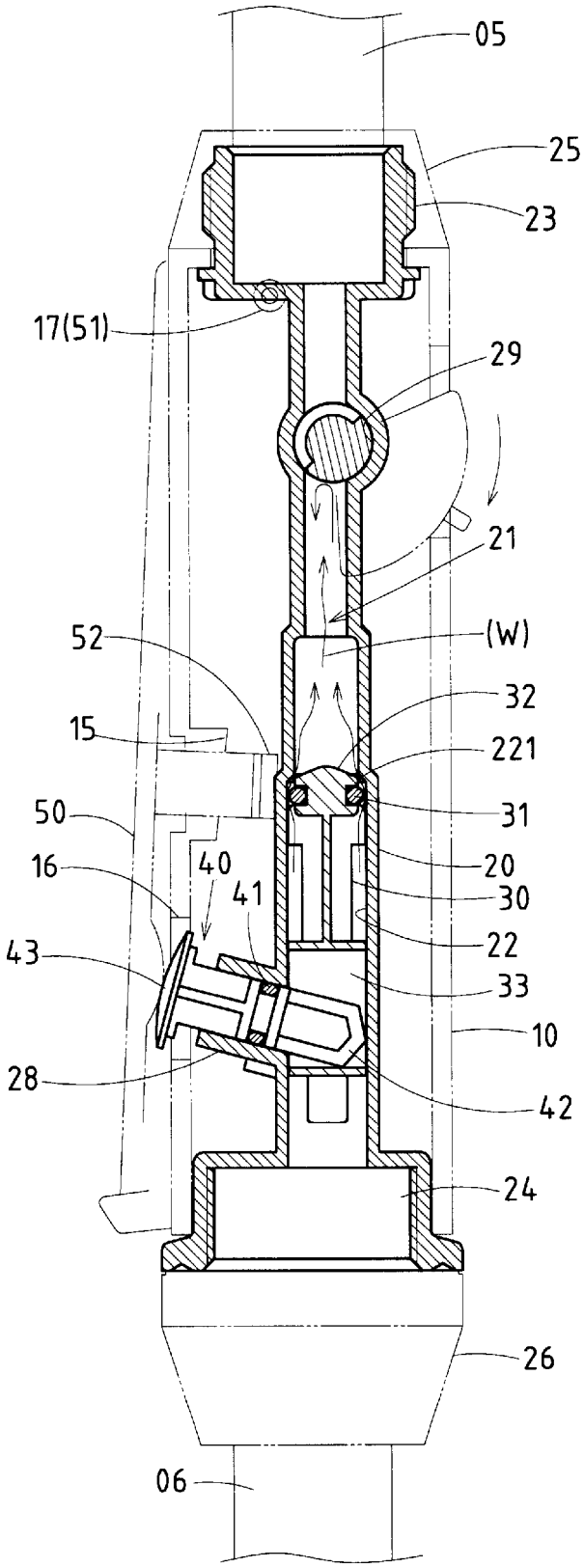
FIG. 6 shows a longitudinal sectional view of the preferred embodiment of the present invention with the thumbknob thereof being at work.
Figure 7:
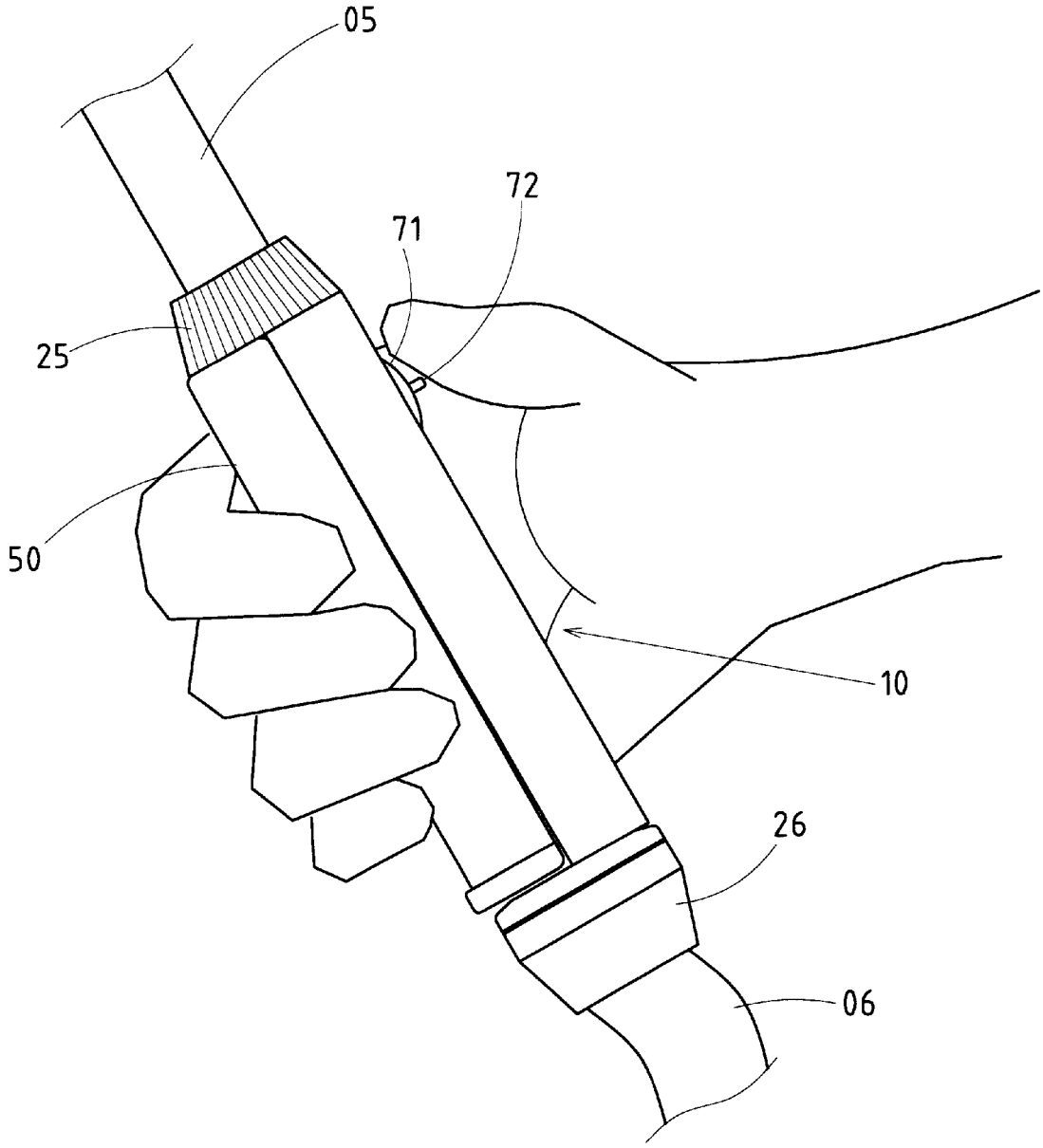
FIG. 7 shows a side schematic view of the preferred embodiment of the present invention in use.

A control lever 50 is provided in two inner sides of the top end with a pivot 51 by which the control lever 50 is pivoted with the handle 10 in conjunction with the pivoting holes 17 of the handle 10. The control lever 50 is provided at the midsegment with a retaining hook 52, which is retained in the retaining slot 15 of the handle 110. The outer end 43 of the link rod 40 is rested against the inner wall of the bottom segment of the control lever 50, as shown in FIG. 6.

A second water control valve 60 is disposed in the horizontal through slot 29 of the water guiding inner tube 20 and is provided in the midsegment with an arcuate guide slot 61 which is aligned with the water duct 21 of the water guiding inner tube 20. The second water control valve 60 is provided with a washer 62, and in two ends with a rib 63 and a pillar 64.

A thumbknob 70 has an arcuate control face 71, which is jutted out of the receiving slot 14 of the handle 10 and is provided with a projected edge 72 to facilitate the maneuvering of the thumbknob 70 with the thumb. The thumbknob 70 is provided in the inner end with two lugs 73, which are provided with an insertion slot 74 and a locating hole 75 for joining respectively with the rib 63 and the pillar 64 of the second water control valve 60.

Figure 5:
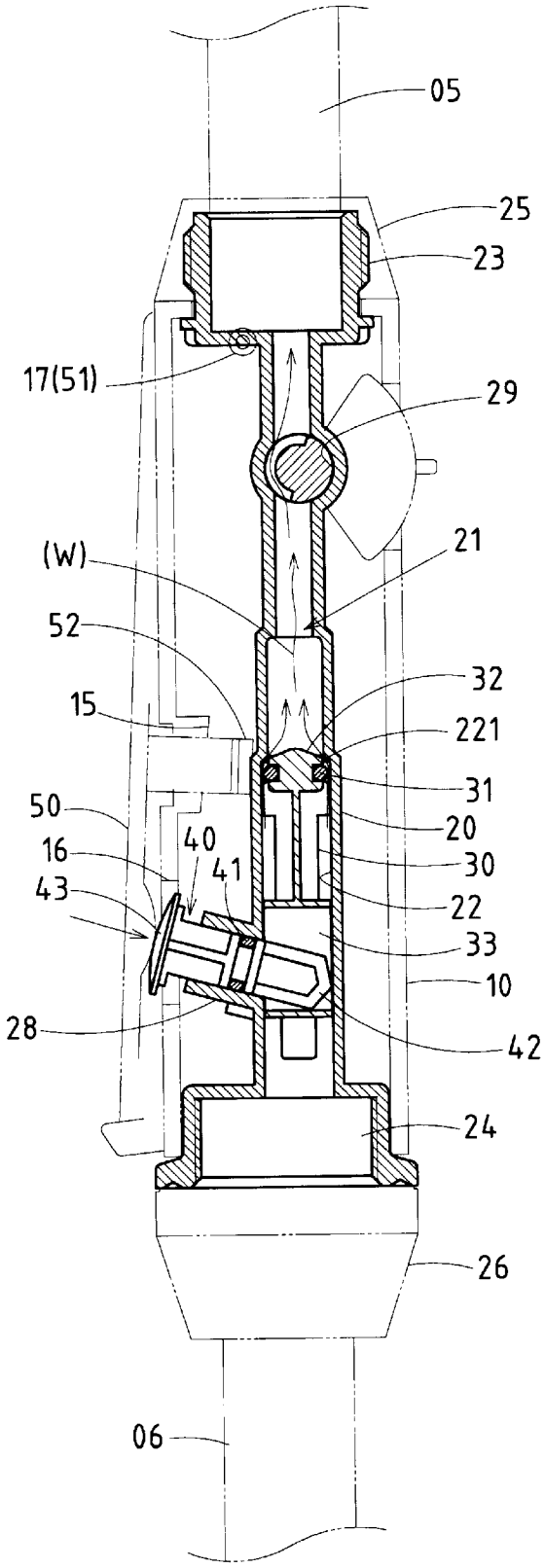
FIG. 5 shows a longitudinal sectional view of the preferred embodiment of the present invention with the control lever thereof being at work.

As shown in FIG. 5, the control lever 50 is held in one hand of a user of the pistol-type spray nozzle of the present invention such that the link rod 40 is moved inward to cause the inner end 42 of the link rod 40 to push the first water control valve 30 to slide downward, thereby resulting in the withdrawal of the tapered head 32 of the first water control valve 30 from the narrow edge 221 of the valve slot 22 so as to allow the passage of the water "W".

With the thumb moving the thumbknob 70 up and down, the second water control valve 60 is actuated to turn to enable its arcuate guide slot 61 to be or not to be in communication with the water duct 21 of the water guiding inner tube 20, so as to turn on the water flow as shown in FIG. 5, and to turn off the water flow as shown in FIG. 6. In the meantime, the other four fingers of the hand hold the control lever 50.

Figure 8:
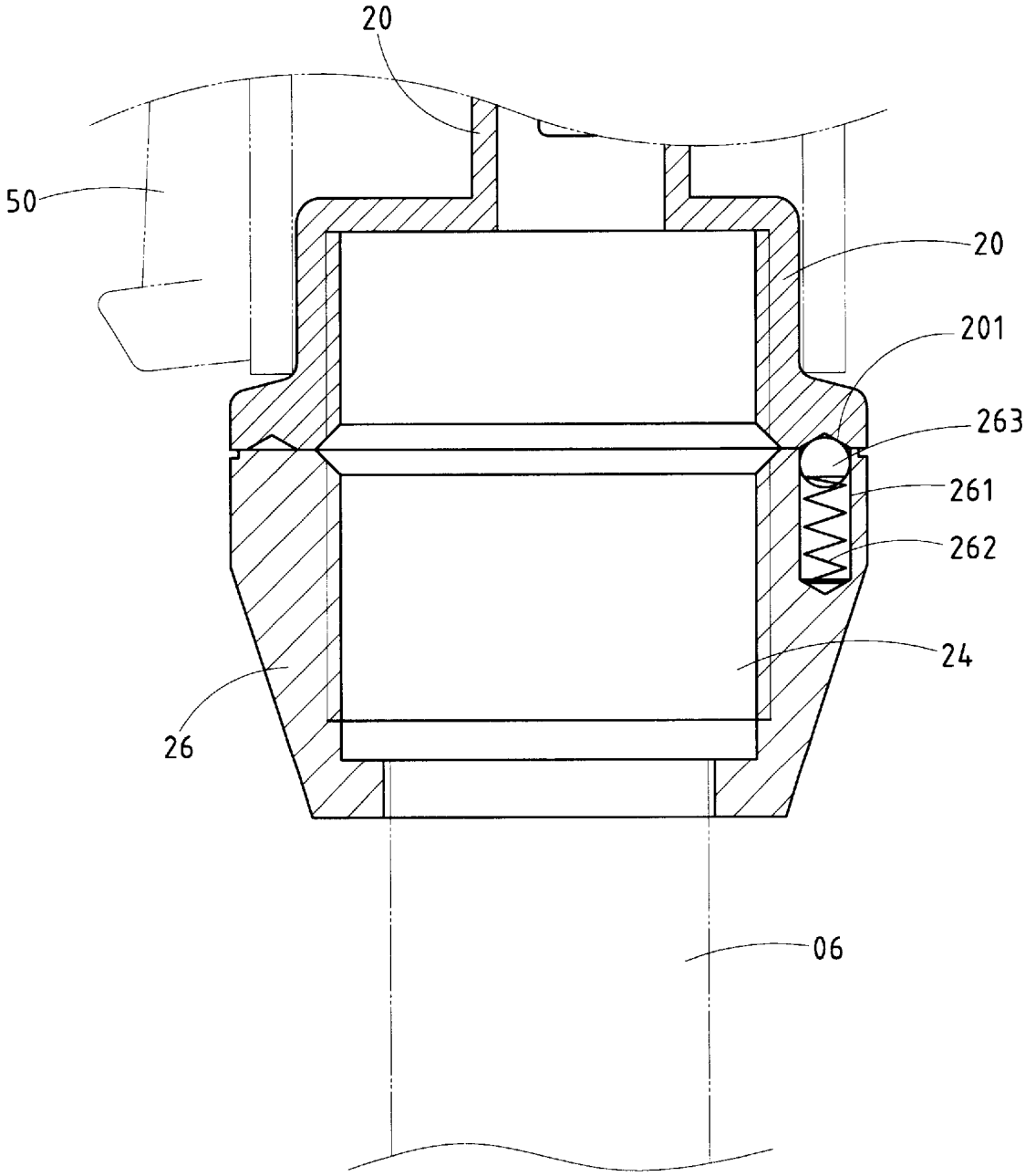
FIG. 8 shows a longitudinal sectional view of a step-by-step locating structure of the handle of the present invention.
Figure 9:
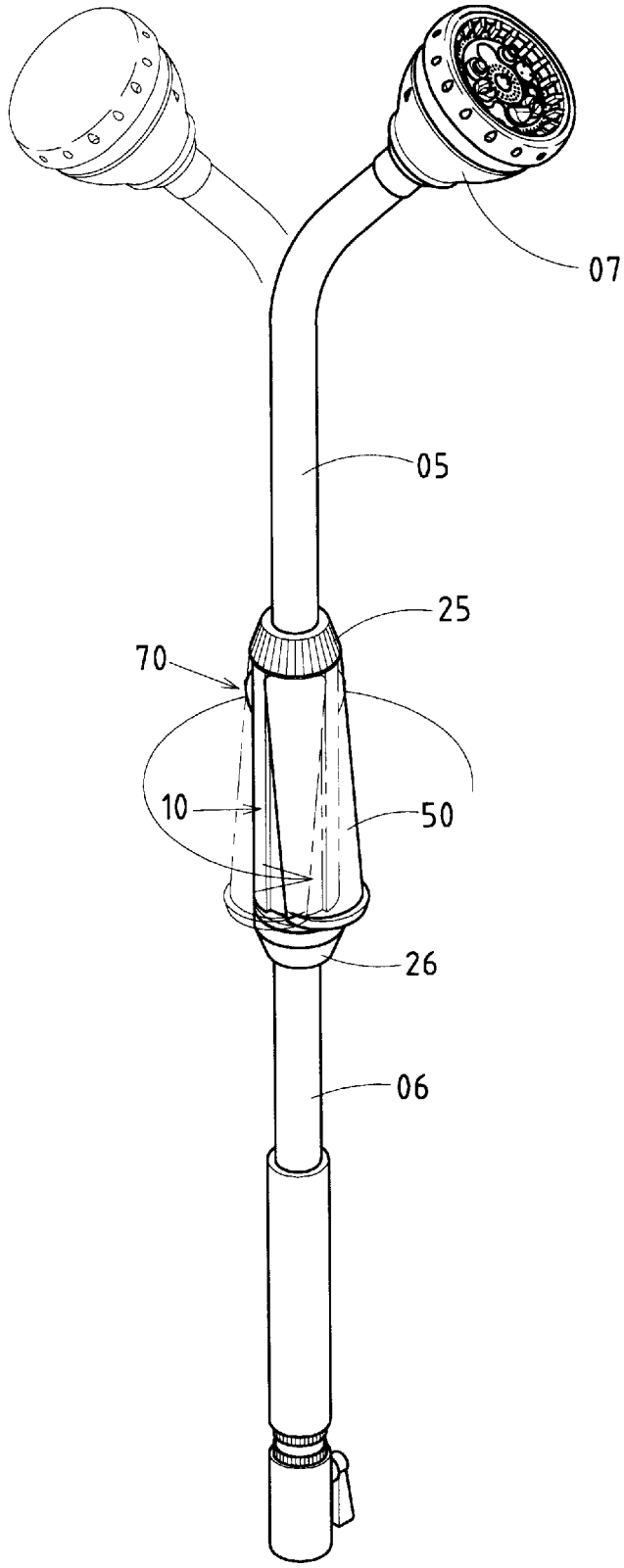
FIG. 9 shows a schematic view of the present invention with the nozzle head thereof being adjusted in spray direction by the rotation of the handle thereof.

As shown in FIGS. 8 and 9, the lower fastening ring 26 of the water guiding inner tube 20 is provided at a top end with an upright slot 261 in which a spring 262, and a ball 263 are disposed to enable the bottom end of the water guiding inner tube 20 to be provided with a series of locating cavities 201 which are arranged at an interval. The spray direction of a nozzle head 07 is changed by turning the handle 10 to cause the ball 263 of the upright slot 261 to move into one of the locating cavities 201.

The embodiment of the present invention described above is to be regarded in all respects as being illustrative and nonrestrictive. Accordingly, the present invention may be embodied in other specific forms without deviating from the spirit thereof The present invention is therefore to be limited only by the scope of the following claims.

I claim:

1. A pistol-type spray nozzle comprising:

a handle comprised pf a top hole, a bottom hole, in an inner wall with a plurality of fastening pillars, in a top segment with a receiving slot, in a midsegment with a retaining slot, in a bottom segment with a through slot, and two pivoting holes located in the top segment thereof;

a water guiding inner tube disposed in said handle and comprised of a water duct, a valve slot located in a bottom segment of said water duct, an upper threaded tube fastened to a top end of said water guiding inner tube such that said upper threaded tube is extended out of said top hole of said handle, a lower threaded tube fastened to a bottom end of said water guiding inner tube such that said lower threaded tube is expended out of said bottom hole of said handle, an upper fastening ring engaged with said upper threaded tube for fastening said handle to a top rod, a lower fastening ring engaged with said lower threaded tube for fastening said handle to a bottom rod, a plurality of fastening tubes which are engaged with said fastening pillars of said handle, an inclined projected tube located at a bottom segment of said water guiding inner tube, and a horizontal through slot located at a top segment of said water guiding inner tube;

a first water control valve disposed in said valve slot of said water duct of said water guiding inner tube and comprised of, at a top end, a tapered head capable of joining with a narrow edge of said valve slot, said first water control valve further comprised of, at a bottom end, a through slot;

a link rod disposed in said inclined projected tube of said water guiding inner tube and comprised of a triangular inner end which is disposed in said through slot of said first water control valve, said link rod further comprised of a semispherical outer end which juts out of said inclined projected tube and said through slot of said handle;

a control lever comprised of, at a top end, two pivots for pivoting said control lever with said handle in conjunction with said two pivoting holes of said handle, said control lever further comprised of, at a midsegment, a retaining hook which is retained in said retaining slot of said handle whereby an inner wall of a bottom segment of said control lever is in contact with said outer end of said link rod;

a second water control valve comprised of, in a midsegment, an arcuate guide slot, and in two ends thereof, a rib and a pillar, said second water control valve being disposed in said horizontal through slot of said water guiding inner tube such that said arcuate guide slot of said second water control valve is aligned with said water duct of said water guiding inner tube; and a thumbknob having an arcuate control face which juts out of said receiving slot of said handle and is comprised of a projected edge to facilitate the moving of said thumbknob with a thumb whereby said thumbknob is comprised of, in an inner end, two lugs which are in turn comprised of an insertion slot and a locating hole, with said insertion slot being joined with said rib of said second water control valve, and with said locating hole being joined with said pillar of said second water control valve, thereby enabling said thumbknob to actuate said second water control valve to turn to cause said arcuate guide slot of said second water control valve to be or not to be in communication with said water duct of said water guiding inner tube.

2. The pistol-type spray nozzle as defined in claim 1, wherein said lower fastening ring of said water guiding inner tube is comprised of, in a top end, an upright slot, a spring disposed in said upright slot, and a ball disposed in said upright slot; wherein the bottom end of said water guiding inner tube is comprised of a series of locating cavities; wherein said ball is moved into one of said locating cavities at a time when said handle is turned, thereby resulting in a change in spray direction of a nozzle head which is fastened to the top rod that is in turn fastened with said handle.

* * * * *